United States Patent [19]

Severin et al.

[11] 4,039,786

[45] Aug. 2, 1977

[54] ARROW SWITCH

[76] Inventors: Roger Severin, 27 Buena Place, Red Bank, N.J. 07701; Emil H. Lovenberg, 28 Edgemere Drive, Matawan, N.J. 07747

[21] Appl. No.: 635,748

[22] Filed: Nov. 26, 1975

[51] Int. Cl.[2] ..... H01H 1/38

[52] U.S. Cl. ..... 200/163; 200/16 B

[58] Field of Search ..... 200/163, 153 S, 153 SC, 200/50 AA, 154, 48 R, 48 P, 48 A, 48 CB, 48 V, 48 SB, 16 E, 16 B, 258–261, 287, 288, 286; 317/103, 9 R

[56] References Cited

U.S. PATENT DOCUMENTS

| | | | |
|---|---|---|---|
| 964,536 | 7/1910 | McLewee | 200/163 |
| 2,233,605 | 3/1941 | Gunther | 200/163 |
| 2,363,925 | 11/1944 | Cotter | 200/16 E X |
| 2,509,217 | 5/1950 | Davis | 200/163 X |

FOREIGN PATENT DOCUMENTS

| | | | |
|---|---|---|---|
| 579,459 | 7/1959 | Canada | 200/16 E |

*Primary Examiner*—Robert K. Schaefer
*Assistant Examiner*—Morris Ginsburg
*Attorney, Agent, or Firm*—Victor J. Evans & Co.

[57] ABSTRACT

The present invention comprises an ultra-fast operating switch which may be responsive to any desired predetermined circuit condition. The electrical circuit completing component of the switch moves in a straight line, for a reasonably short distance, to provide the connotation of "arrow" switch and may be designed to either make or break circuit continuity in response to potential, or current, or programming.

1 Claim, 8 Drawing Figures

FIG. 1.
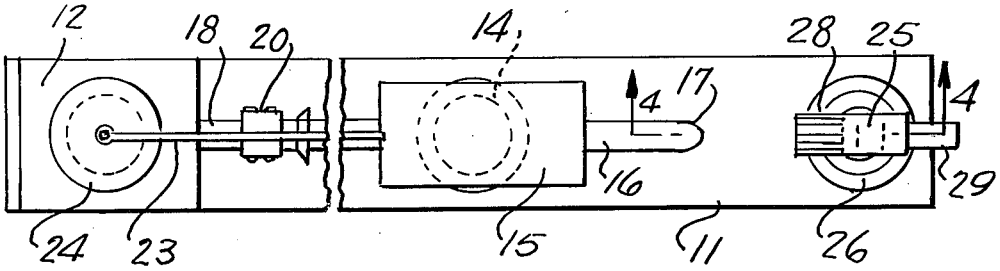
FIG. 2.
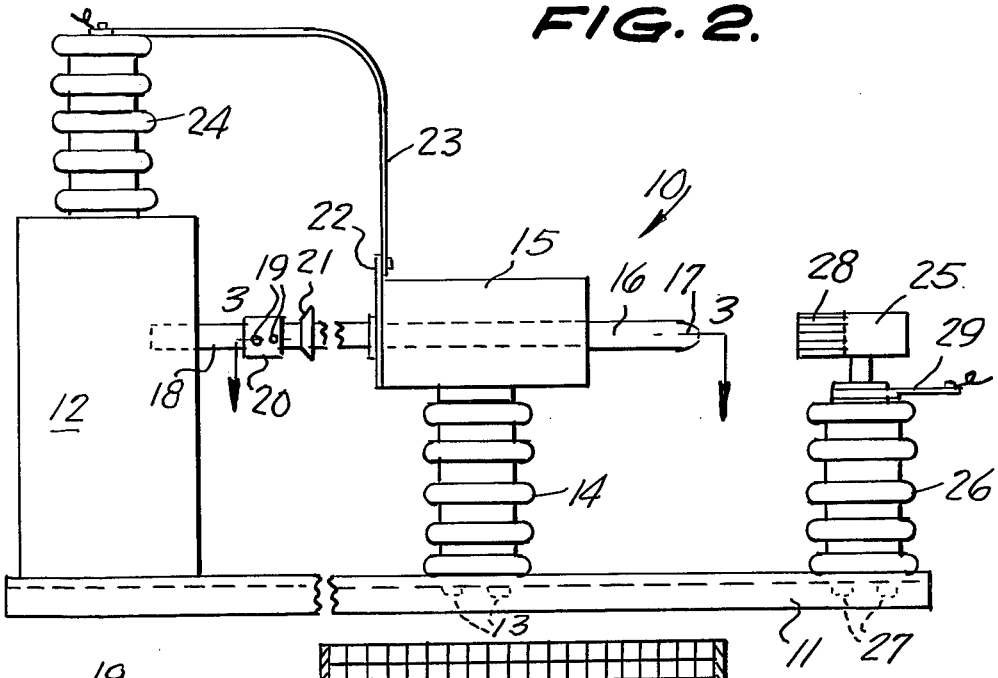
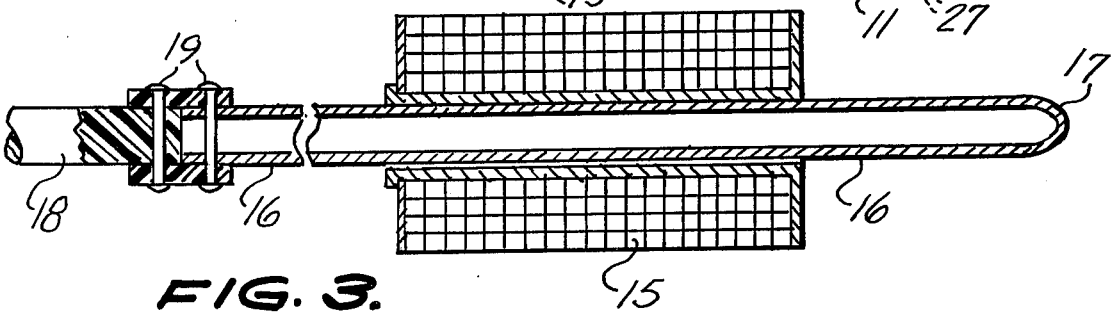
FIG. 3.

ARROW SWITCH

BACKGROUND OF THE INVENTION

FIELD OF THE INVENTION

The operation of many of the switches that are in service and have a hinge, blade and jaw contacts, is such that when the switch starts to open, the tail of the blade which makes contact in the jaw, has to turn 90° before it begins to open and this is lost time. Then the blade opens in a radius, which is time consuming, and this operation is made through the medium of an operating pipe which is connected to the interphase linkage, with more lost time.

In an electrical circuit, switches of all types and designs are used by private industries and electric utility companies for different operating needs and requirements. Switches are used manually to remove from service sections of electrical circuits and equipment when its services are no longer needed, or taken out of service for maintenance work. Switches are also used to operate automatically either for a routine type of operation where the mode of operation commands it or under predetermined fault conditions where a relay or sensor detects a malfunction of either the operation, or electrical fault where it is essential to detect and remove an electrical circuit or equipment from the electrical system as soon as possible to limit the damage to the circuit or equipment which would be caused by the high current flow to ground. Also by the quick detection and removal from service of any electrically faulted component of an electrical circuit or system it creates a more stable system. When electrical faults occur, the current flow increases and the voltage decreases, which is a very unstable condition, and this undesirable unstable condition burdens down the circuits by the high amplitude of fault current and also the low voltage places a burden on all types of rotary electrical equipment.

In the clearing from service of an electrical circuit, or piece of equipment, it is necessary to have a visible break or gap between the source of electricity and the circuit, or equipment, to be worked upon for safety reasons so that there is no doubt that the circuit or equipment is deenergized and can be worked upon safely.

In many cases in private industry and in the electrical utility companies, the electrical switches used to remove from service, either by design or by fault conditions, an electrical circuit or equipment is called an "oil circuit breaker." An oil circuit breaker is constructed so that the contacts which open to deenergize an electrical circuit or equipment are immersed in a tank of oil. These contacts are not visible and to provide the necessary visible break or gap for safety reasons, a switch consisting of a hinge, blade and jaw is also used in series with the oil circuit breaker.

The design and the operation of the present arrow switch takes into consideration all of the aforementioned conditions. It can be operated manually by the means of an operating pipe, electrically by pushing an open-close button, can be programmed by relaying or sensors to operate for specific operations, can be operated by relays automatically when an abnormally high flow of current is detected by the current transformer in an electrical circuit and when opened and locked open gives the safety requirements needed to work on electrical circuits or equipment.

The desin and operation of the arrow switch is radically new and different from the types in use today. It is constructed so that the close-open operations are completed with a straight line thrust of the blade from the blade guide to the jaw contact (close position), or the jaw contact to the blade guide (open position). This operation can be computed mathematically and with no lost time due to the operating pipe inter-phase linkage, operating in a straight line, no lost time due to a radius, and no need for the blade to turn to seat properly. This complete operation of the arrow switch is much faster when computed electrically in cycles (60 cycles per second) and in operating to clear an electrical fault time is the most important factor.

The need for the arrow switch design and operation in today's electrical utility systems is much desired and timely because of the complexity of these systems (mainly the 34.5 KV distribution systems) the mode of operation, the cost of the arrow switch versus the accepted practice in the industry of using an oil circuit breaker and a visible break switch to accomplish the same operation and safety clearance.

The insulation value and current carrying capability of the arrow switch is not limited to any set voltage or current carrying capabilities. The arrow switch would be constructed using existing proven materials and to the specifications set forth by the National Electrical Manufacturing Association, which sets the standards for the electrical utilities, nation wide.

The method of operating either manually, electrically or automatically would be dictated by the operation requirements. The basic arrow switch can be modified to incorporate any and/or all the options, such as manual or electromagnetic mode of closing and opening of the arrow switch, potential and current transformers for detection of loss of voltage and/or fault current for automatically sectionalizing of circuits and which can be programmed to open to clear transient or lightening faults and then reclose automatically after a predetermined period of time (time delay).

The arrow switch can fulfill a void which now exists in the operation of an electrical system by being comparably inexpensive to existing equipment now in use, versatile in its application to an electrical system and make some electrical systems more stable where fuses are now used to detect and clear faults and when fuses blow, circuits remain out of service until the fuses have been replaced.

SUMMARY OF THE INVENTION

The present invention of an ultra-fast operating switch includes a contact arm which moves a relatively short distance, in a straight line, and may be utilized to either make or break a circuit. Activating circuitry which may be responsive to a predetermined value of voltage, or of current, moves the contact arm into or out of engagement with a fixed contact member to accomplish any of a variety of electrical functions. The motivating circuitry may also be programmed to become active on some predetermined condition. The sliding contact arm, and the fixed contact member are positioned on conventional insulators, or if desired potential or high current transformers may be used.

The primary object of the invention is to provide a fast acting switch having a minimum of moving parts and lost motion.

Other objects and advantages will become apparent in the following specification when considered in light of the attached drawings.

BRIEF DESCRIPTION OF THE DRAWINGS

FIG. 1 is a top plan view of the invention;

FIG. 2 is a side elevation view of the invention;

FIG. 3 is a vertical sectional view taken along the line 3—3 of FIG. 2, looking in the direction of the arrows;

DESCRIPTION OF THE PREFERRED EMBODIMENT

Figure 4:
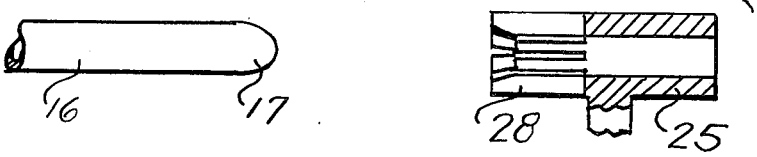
FIG. 4 is a horizontal sectional view taken along the line 4—4 of FIG. 1, looking in the direction of the arrows.

Referring now to the drawings in detail, wherein like reference characters indicate like parts throughout the several figures, the reference numeral 10 indicates generally the switch making up the present invention, and which is designated as the arrow switch.

The switch 10 has its various components mounted upon a base 11, which may take the form of a galvanized steel channel to offer substantial support. At one end of base 11 there is located a drive mechanism and relay cabinet 12, shown in the drawings as a rectangular configuration for simplicity. Within the drive mechanism and relay cabinet 12, the contents of which is also not shown for further simplicity, there is any form of preselected relay or activating mechanism which has been chosen to motivate the switch, and which will be described in more detail hereinafter.

About the middle of the base 11 there is anchored, by means of bolts 13, a pedestal-type insulator 14, and fastened to the top of insulator 14 there is a tubular shaped guide 15, along the center axis of which there is positioned a movable contact arm 16. Movable contact arm 16 comprises a straight piece of copper piping, sized to suit the current carrying requirements of the design of the switch. It should be noted that the outer extremity of arm 16 has a rounded end 17.

protruding through the side of relay cabinet 12 there is a driving rod 18, constructed of insulating material such as herculite, micarta, fibre-glass, or the like. The inner end of driving rod 18 is connected to some form of relay, or activating device, (not shown) while the other end of driving rod 18 is fastened by rivets 19, or the like, to the center position of a connecting bar 20, also constructed from insulated material, as was driving rod 18.

Also fastened to connecting bar 20 at its center position, by means of rivets 19, so that it abuts and is in contact with driving rod 18, is one end of the copper pipe forming movable contact arm 16. It should be borne in mind, and noted in FIG. 3, that there is not electrical continuity where driving rod 18 and movable arm 16 touch in the connecting bar 20, since driving rod 18 is insulating material, as is connecting bar 20.

A short distance along movable arm 16 from connecting bar 20, and adjustably attached to arm 16, there is a stop lug 21 having the general configuration of a curved collar, bending in the direction of guide 15.

Also attached to, and forming an end of, the guide 15 there is a metal plate 22 which is used as a terminal for an external connection cable 23. Cable 23 is rigidly mounted on the top of relay cabinet 12 by means of an insulator 24, or some other chosen spacer.

Figure 5:
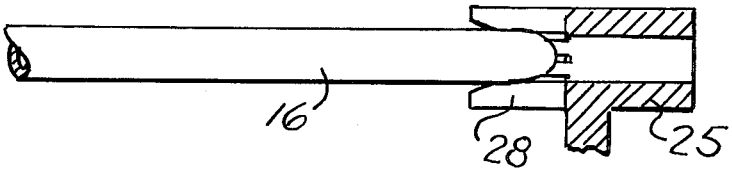
FIG. 5 is an enlarged view of the movable arm nested into the fixed contact.

At the far end of the base 11 from relay cabinet 12 there is a fixed contact and load break mechanism 25 which is adapted to receive the moving contact 16 when the relay has been energized. Fixed contact 25 is supported on base 11 by means of an insulator 26 that is fastened to base 11 by means of bolts 27 on the bottom of the base. The inner end of fixed contact 25 has the configuration of a plurality of parallel strips, or fingers 28, that are arranged to receive rounded end 17 of movable contact 16. Since fingers 28 are flexible, and the inner diameter of contact 25 is slightly smaller than the diameter of rounded end 17, the fingers 28 will expand to receive rounded end 17, as clearly shown by the view of FIG. 5, thereby insuring a good physical and electrical contact between the two components.

Also forming a part of fixed contact 25, and resting on the top of insulator 26, there is an external bracket 29 which serves to provide electrical connections to some form of remote circuit (not shown). Thus, when the movable contact 16 is energized, an electrical circuit is made up of cable 23, metal plate 22, stop lug 21, movable contact 16, rounded end 17, fingers 28, fixed contact 25, external bracket 29, and external remote circuit attached to bracket 29.

It should be noted at this point that if, for circuit convenience or necessity, it is desirable to have current and potential transformers incorporated in the device of the invention, then the guide means 15 could be a current transformer winding with the movable contact 16 placed through the core of the transformer. Likewise, insulator 14 may be replaced by a potential transformer, if so desired.

Figure 6:
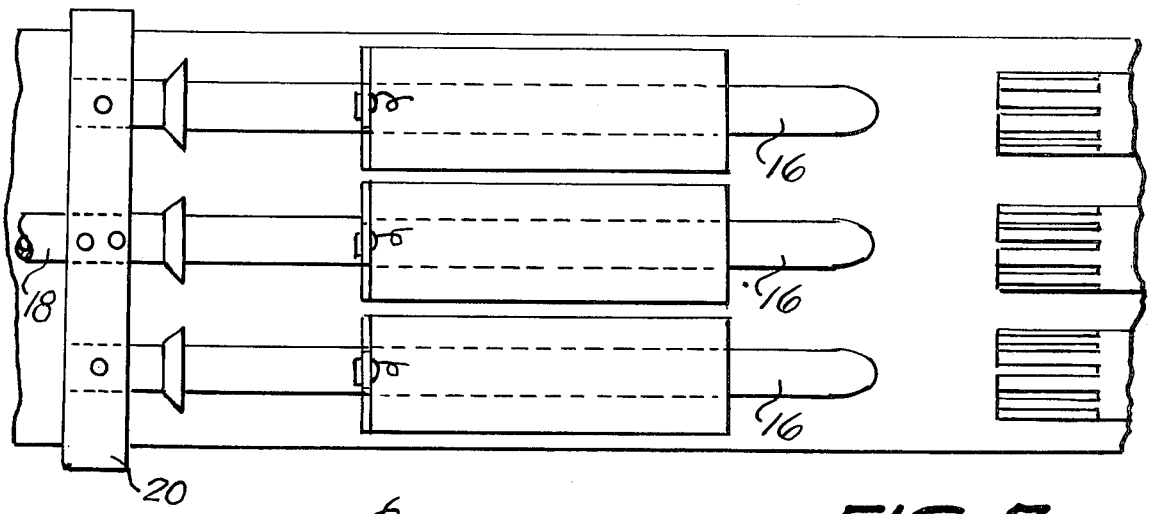
FIG. 6 shows a plan view of the movable arm adapted for three phase potential.
Figure 7:
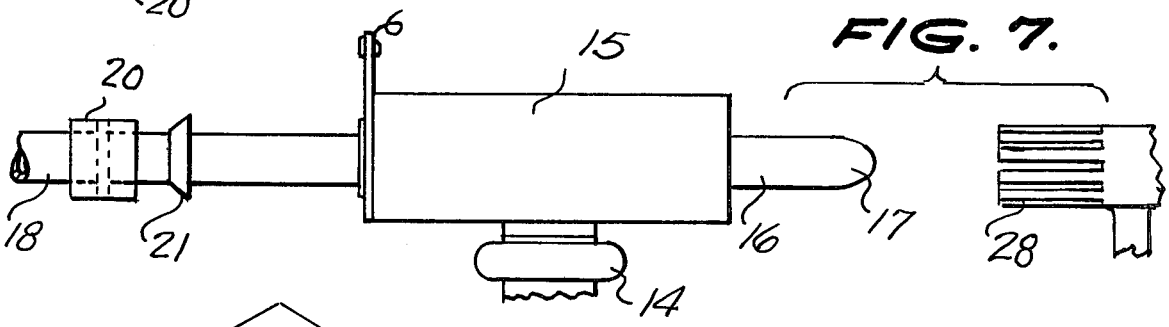
FIG. 7 shows an enlarged view of the movable arm, and fixed contact, in open circuit condition.
Figure 8:
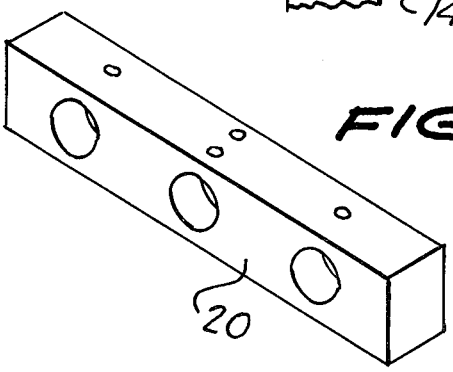
FIG. 8 is an enlarged view of the connecting bar used with three phase potential to tie together the movable arms.

Should a three phase potential be the kind that the switch is called upon to control, then there will be three movable contacts 16, and a somewhat elongated connecting bar 20, joining these three contacts, as shown in FIG. 6. The driving bar 18 will be riveted to the center of the connecting bar 20 so that all three contacts move together.

In operation, the sensing circuits, whether they are air, solenoid, linkage, overload, current, potential, etc. that are located in relay cabinet 12, are activated in response to their designed purpose. These activating means then push on drive rod 18 in a horizontal direction which in turn pushes connecting bar 20 and stop lug 21 and contact arm 16, until the rounded end 17 makes contact with fingers 28, to thus carry the electrical load through bracket 29, which is connected to some remote external system. As pointed out previously, when the switch is activated, a circuit is completed through cable 23, end plate 22, collar 21, movable contact 16, fixed contact 25 and end bracket 29.

From the about description of the structure and operation of the present invention it is clear that there has been disclosed an ultra-fast operating switch which may be responsive to any desired predetermined condition.

Having thus described the preferred embodiment of the invention, it should be understood that numerous structural modifications and adaptations may be resorted to without departing from the spirit of the invention.

What is claimed is:

1. A fast acting switch comprising a base having activating means disposed thereon, a driving rod extending outwardly from, while coupled to said activating means, said driving rod being made of an insulating material, a connecting bar remote from said activating means and attached to the extremity of said driving rod, a contact arm fastened to said connecting bar and oriented with said driving rod and connecting bar to provide a substantially axially aligned continuum of these three last named elements when said activating means is either energized or deenergized, guide means overlying a portion of said contact arm, lug means fastened to said contact arm and disposed between said connecting bar and said guide means, plate means disposed on said guide means nearest said lug means and insulated from said contact arm and having cable means leading away therefrom to a circuit, load break means lying along the same axis as said contact arm and fashioned to receive the extremity of said contact arm remote from said connecting bar, said load break means and said connecting bar oriented so as to be on opposite sides of said guide means, said load break means having cable means leading away therefrom to the same circuit, whereby when the circuit is to be deenergized, said activating means has said lug means remote from said plate means and said load break means remote from said contact arm, and when the circuit is to be energized said activating means has said lug means tangent to said plate means and said load break means overlying and connected to the extremity of said contact arm, to provide electrical continuity.

* * * * *